US007750570B2

(12) United States Patent
Kroes et al.

(10) Patent No.: US 7,750,570 B2
(45) Date of Patent: Jul. 6, 2010

(54) GLOW-SWITCH STARTER, LIGHTING DEVICE AND LIGHTING SYSTEM THEREWITH, AND USE THEREOF

(75) Inventors: Anthony Kroes, Terneuzen (NL); Rob Van Rooij, Roosendaal (NL); Olaf Mastenbroek, Turnhout (BE); John Daniels, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 344 days.

(21) Appl. No.: 11/816,719

(22) PCT Filed: Feb. 17, 2006

(86) PCT No.: PCT/IB2006/050530

§ 371 (c)(1),
(2), (4) Date: Aug. 21, 2007

(87) PCT Pub. No.: WO2006/090319

PCT Pub. Date: Aug. 31, 2006

(65) Prior Publication Data

US 2008/0150426 A1 Jun. 26, 2008

(30) Foreign Application Priority Data

Feb. 28, 2005 (EP) ..... 05101501

(51) Int. Cl.
*H01J 17/00* (2006.01)
*H01J 61/00* (2006.01)
*H01J 7/44* (2006.01)
*H05B 41/14* (2006.01)

(52) U.S. Cl. ..... 313/619; 313/572; 313/567; 313/568; 315/32; 315/49; 315/94; 315/100

(58) Field of Classification Search ..... None
See application file for complete search history.

(56) References Cited

U.S. PATENT DOCUMENTS 2,332,809 A 10/1943 Peters
4,562,381 A * 12/1985 Hammer et al. ..... 315/99
4,937,500 A 6/1990 Christophorou et al.

(Continued)

FOREIGN PATENT DOCUMENTS

DE 1025074 2/1958

(Continued)

OTHER PUBLICATIONS

Machine translation of DE 2,737,154 (Lueck).*

*Primary Examiner*—Nimeshkumar D Patel
*Assistant Examiner*—Natalie K Walford

(57) ABSTRACT

The present invention relates to glow-switch starters 1, lighting devices therewith and use thereof. The glow-switch starter 1 is suitable for use with three phase supply voltages substantially higher than the common 230V supply voltage 26. This allows more efficient gas discharges in e.g. fluorescent lamps 20, and/or more lamp power, and/or less energy losses in ballasts 22 and lamp electrodes. To make the glow-switch starter suited for such use, according to the invention, the gas filling 5 of the starter 1 is adapted. An important criterion is that the glow current in the steady state operation of the fluorescent lamp that is started by the starter is small enough to prevent closing of the (bimetallic) switch.

20 Claims, 3 Drawing Sheets

U.S. PATENT DOCUMENTS

Figure 1:
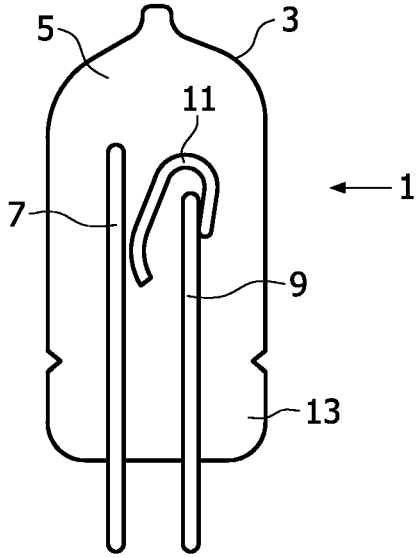

| | | | | |
|---|---|---|---|---|
| 5,001,391 | A | 3/1991 | Kling et al. | |
| 6,194,846 | B1 * | 2/2001 | Van Veldhuizen | 315/309 |
| 6,404,128 | B1 | 6/2002 | Kroes | |
| 6,657,389 | B2 | 12/2003 | Saitou et al. | |
| 2002/0185977 | A1 | 12/2002 | Saitou et al. | |

FOREIGN PATENT DOCUMENTS

| | | |
|---|---|---|
| DE | 2737154 | 3/1979 |
| GB | 640948 | 8/1950 |

* cited by examiner

GLOW-SWITCH STARTER, LIGHTING DEVICE AND LIGHTING SYSTEM THEREWITH, AND USE THEREOF

The present invention relates, in a first aspect, to a glow-switch starter, constructed for use with a fluorescent lamp, and comprising a substantially gas-tight housing, an ionizable gas filling, at least two electrodes and at least one bimetal switching device.

Such a starter is well known in the art, and is in common use for igniting e.g. tubular fluorescent lamps. Its functioning is deemed well understood by the person skilled in the art, and will only be elucidated upon when this is relevant for understanding the invention. For example, U.S. Pat. No. 6,657,389 discloses a glow discharge lamp for use as a glow starter for discharge lamps. The gas filling consists of neon as a primary constituent (at least 40%) and at least one of krypton, xenon and argon, while helium, hydrogen or organic gas may be added.

A problem in the art, relating to glow-switch starters, is the following. Gas discharge lamps require a current limiter to prevent their destruction after ignition. Very often, this current limiter comprises a ballast with a large coil, connected in series with the discharge lamp. When the discharge lamp is operating, the current flows through the discharge lamp, the electrodes thereof and through the ballast. Even with carefully selected components, this will cause energy losses, due to resistive heating, which may amount to 10-15% or even more of the total energy consumption.

One way of increasing the efficiency is by increasing the lamp voltage, i.e. the voltage over the discharge, while at the same time decreasing the lamp current, in order to maintain the total lamp power at a constant level. Increasing the lamp voltage is limited due to a number of factors, such as of course the mains supply voltage.

The mains supply voltage may e.g. be increased by using a three phase wiring of the normal 230-240V mains supply voltage. This offers an increased nominal supply voltage of about 400V. Simply replacing the 230-240V mains connection by a three phase (400V) connection however causes problems when operating the lamp. The lamp may show blinking, the starter life may be reduced, etc., which is undesirable.

It is an object of the present invention to provide a glow-switch starter of the kind mentioned above, with which lamp operation at an increased nominal supply voltage of higher than 250 Vrms is more reliable.

According to the first aspect of the present invention, this object is achieved with a glow-switch starter according to claim 1.

The inventor has discovered that at least part of the problems relating to more unreliable lamp operation with common starters and at increased lamp voltage are due to parallel glowing of the starter during operation of the gas discharge lamp, in the steady state. Said parallel glowing is caused by the lamp voltage, which is also substantially supplied to the starter. This voltage across the starter reaches a reignition peak during reignition of the lamp, after the supply voltage has crossed the zero, and which lasts a certain period of time. Especially during the reignition peak, the voltage across the starter is so high that the glowing of the starter caused thereby heats the bimetal switch sufficiently to cause closing thereof, which in turn causes extinction of the lamp. This is of course undesirable. Note that in some cases the heating during normal lamp operation, after reignition, may suffice to cause (additional) heating of the starter's bimetal switch. It is noted here that parallel glowing is not the same as the glowing during initial start-up. Initially, the lamp is off and cold, and the full mains voltage is provided across the starter, which heats up under the influence of the glow discharge. This glow discharge lasts several full cycles. Contrarily, when the lamp is hot and ignited, parallel glowing of the starter only takes place during a fraction of each cycle, and heating up should be minimized.

In the starter according to the present invention, this glowing is reduced by the use of an appropriate filling of ionizable gas, which allows a reduced heating of the switch during steady state lamp operation. It is remarked here that heating of the starter switch due to parallel glow current is not a linear function of the mains or lamp voltage, as will be shown when discussing the embodiments.

Note that the presence of organic gases is undesirable, since they are a known cause of blink phenomena.

The presence of argon is undesirable, since this may cause undesired sputtering phenomena, which may lead to (electrode) metal deposition on the inner wall of the starter housing, and thus to a short circuit.

In a special embodiment, the total pressure is at least 5 mbar. Tests have shown that such a minimum pressure more reliably causes the peak voltage to remain below about 2-2.5 kilovolts, which is desirable to prevent cold ignition of the lamp or breakdown of a parallel capacitor. Even more preferably, the total pressure is at least 10 mbar. Note that 1 mbar is about 101 Pa.

In another special embodiment, neon is present in the ionizable gas filling in a relative amount of less than 10%, preferably less than 2%. Although in itself neon may be a useful gas for use with the filling, and is hence not excluded, in some cases its presence should be reduced. The presence of neon may affect the development of an appropriate reignition peak voltage, and should thus be avoided in those cases in which lamp operation critically depends on this reignition peak.

In a particular embodiment, the ionizable gas filling substantially comprises helium. Herein, the term "substantially" is intended to mean at least 90%, while allowing for admixture of other gases. Helium is a suitable gas for use as an ionizable medium or gas according to the invention. Furthermore, it has a property that it easily leaks away through the wall of the starter, which may give rise to an increase in peak reignition voltage. This may be helpful to support ignition of ageing lamps.

In another particular embodiment, the ionizable gas filling substantially comprises krypton, at a pressure of between 3 and 10 mbar. In yet another embodiment, the ionizable gas filling substantially comprises xenon, at a pressure of between 3 and 15 mbar. Again, the term "substantially" is intended to mean at least 90%. Also, mixtures of the two gases, at a total pressure of between 3 and 10 mbar are possible.

In a special embodiment of the glow-switch starter according to the invention, the ionizable gas filling comprises helium and at least one of xenon, krypton, hydrogen, nitrogen or a mixture thereof, a ratio of helium:(xenon, krypton, hydrogen, nitrogen or the mixture thereof) being between 1.5:1, and 200:1. Admixture to helium of xenon, krypton, hydrogen or a mixture thereof supports ionization of the gas filling, because of the much lower ionization potential of the admixture gases. This also prevents to a certain degree the escape of ionized helium, since in the mixture the helium will be hardly become ionized.

In particular, the gas pressure is between 10 and 35 mbar. Tests have shown that this pressure range is advantageous to obtain the desired effect according to the invention. This range holds generally, but in particular for the helium with admixtures.

In a special embodiment, the ionizable gas filling substantially comprises hydrogen or nitrogen, or a mixture thereof, or wherein the ionizable gas filling substantially comprises neon, at a pressure of between 3 and 15 mbar. It turns out that even with these gases, a suitable ignition behavior may be obtained. Note in particular that, as mentioned above, neon may affect the quality of the reignition peak. Yet achieving the desired effect according to the invention is not excluded, in particular within the indicated pressure range.

This is a special case of the consideration that, once it has been realized that the present problem may be overcome by adapting the gas filling to its new task, in composition and or pressure, the skilled person obtains knowledge about what measures to take. In other words, the invention relates, in a first aspect, to a glow-switch starter, comprising a substantially gas-tight housing, an ionizable gas filling, a bimetal switching device and leads that are electrically connected to the bimetal switching device, wherein the ionizable gas filling is selected such that, when the glow-switch starter is connected across a gas discharge lamp that is connected in series with an appropriate ballast and that is operating in a steady state at a nominal three-phase mains voltage of at least 250V, the glow-switch starter remains in a stable non-closed position. In particular, this relates to a standard three phase supply voltage of nominally about 400V, which is commonly available, even at places where the common mains has a supply voltage of about 230-240V. Note that all the features of the above mentioned special or particular embodiments may be used with the glow-switch starter as described in this paragraph.

Note that throughout this disclosure, the supply voltage is intended to mean the voltage actually used in operating the starter and/or the discharge lamp, and not the supply voltage in cases where some three phase power connection is first transformed or wired down to standard 230-240V mains. In more particular cases, the supply voltage is sufficient to cause a lamp voltage across the lamp, in steady state, which is at least 230V.

In a special embodiment of the starter according to the invention, the ionizable gas filling is selected such that, when the gas discharge lamp is operating in a steady state, the glow-switch starter carries an average parallel glow current of less than 4 milliamperes, and preferably at most about 2.5 mA. This has proven a useful current range.

In a second aspect, the invention relates to a lighting device with a glow-switch starter according to the invention, and in particular operable at a mains supply voltage of at least nominally 250V, and preferably nominally about 400V. A great advantage of the lighting device according to the present invention is that now use may be made of the commonly available three-phase mains supply voltage, leading to a higher efficiency, as described above, however without the problems of lamp blinking.

In particular, the gas discharge lamp is a low-pressure mercury vapor lamp, more particularly a UV fluorescent lamp. The invention allows the design of a more energy efficient lighting device. Alternatively or additionally, the lamp power may be increased, by taking e.g. a similar lamp current but a higher lamp voltage, for example through taking a longer discharge vessel. Higher lamp power may be used to reduce the number of lamps in order to obtain a certain lighting level. It is also possible to increase the lighting intensity, which is especially desirable in the case of UV-lighting, such as in tanning parlors.

In a third aspect, the invention relates to a lighting system with such a glow-switch starter, according to claim 14. Whereas the second aspect of the invention relates to a lighting device that is connectable to a three-phase mains, the third aspect relates to a lighting system actually comprising, connected to, such a three-phase mains. Many applications are conceivable, such as industrial lighting, and tanning devices. Especially these latter devices often have a three-phase mains connection, which is however wired and connected such that the actual supply voltage for the (UV) lighting part is again the 230-240V mains. According to the present invention, the actual supply voltage for the lighting part is the full three-phase mains, or nominally about 400V. Since tanning device designers require ever more power, the present invention is able to provide that extra power, but still with the use of a simple glow-switch starter.

In a fourth aspect, the invention relates to the use of the glow-switch starter in a lighting device according to the invention. Through the realization that glow-switch starters, though adapted, may be used in a three-phase mains environment, a higher lamp voltage may be used, and energy efficiency may be increased.

Figure 2A:
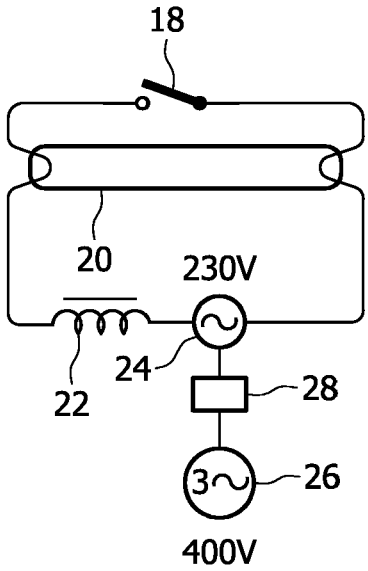
Figure 2B:
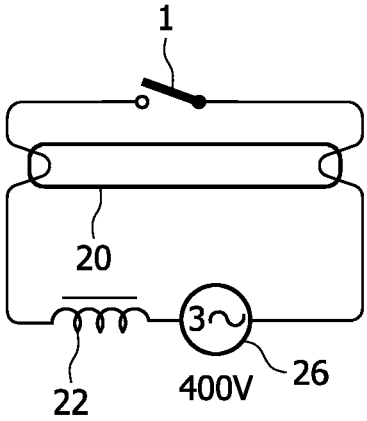
Figure 3:
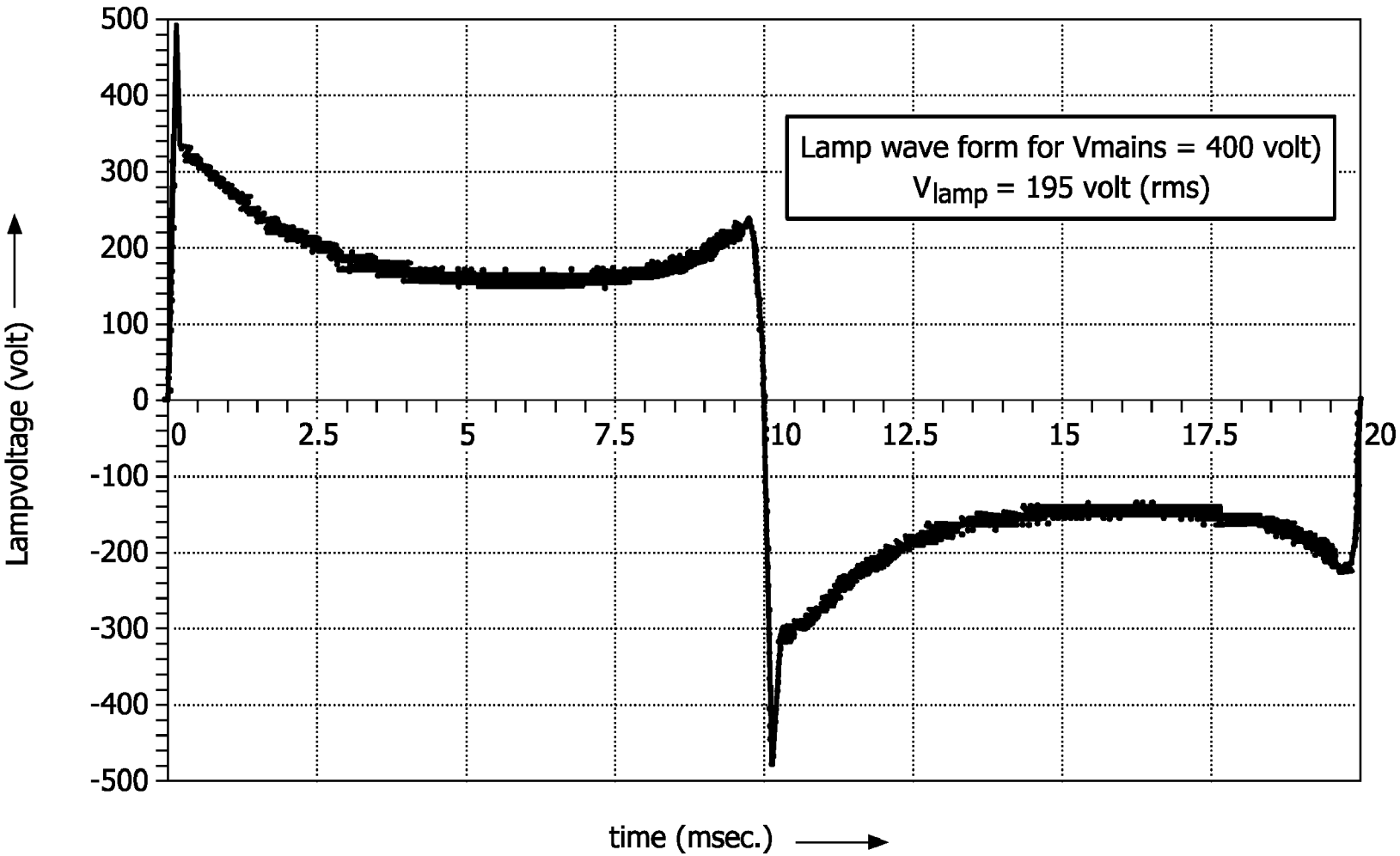

The invention will now be elucidated further, with reference to the drawings, in which:

FIG. 1 schematically shows a glow-switch starter according to the invention;

FIG. 2*a* schematically shows a prior art lighting system, while FIG. 2*b* schematically shows a lighting system according to the invention;

FIG. 3 shows a diagrammatical time-voltage graph of a lamp; and

Figure 4:
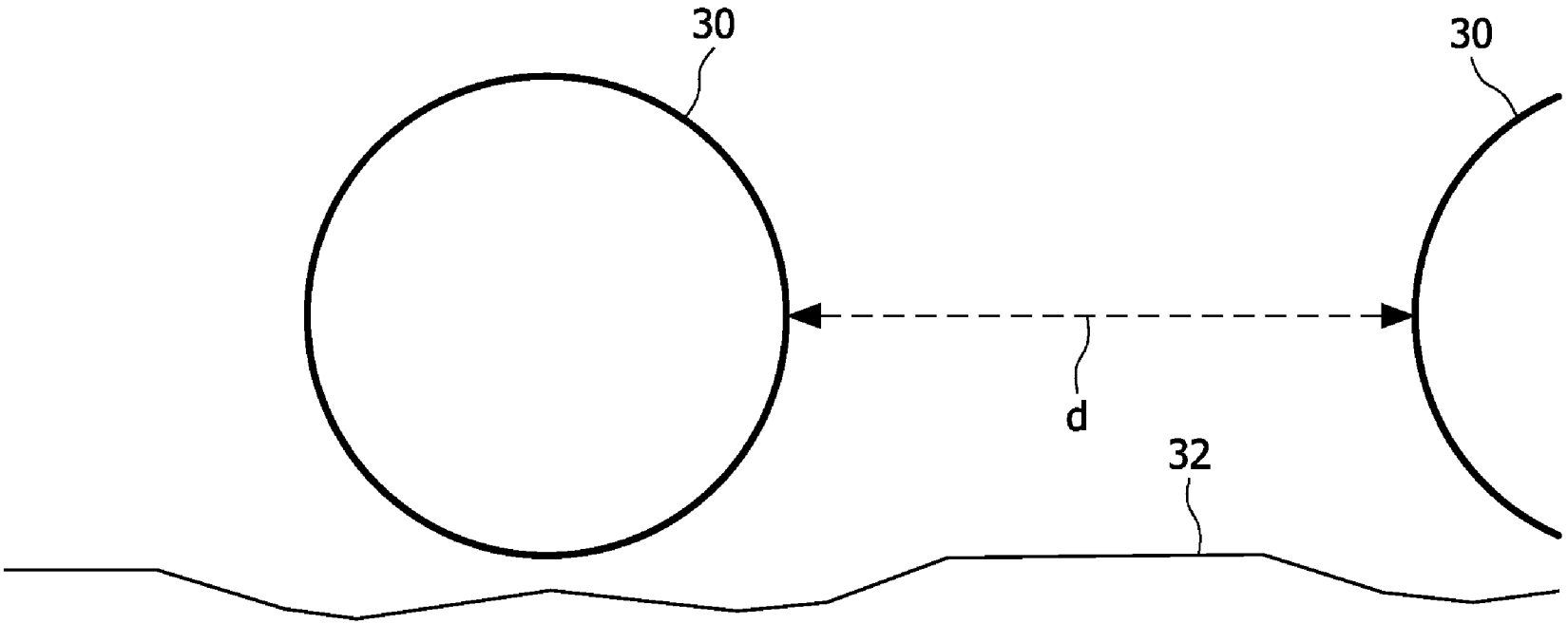

FIG. 4 schematically shows a part of a lighting system according to the invention, comprising a tanning device.

FIG. 1 shows a schematical glow-switch starter 1 according to the invention. Herein, 3 denotes a substantially gas-tight housing with a filling 5 of ionizable medium, a first electrode 7 and a second electrode 9 with a bimetal part 11. 13 denotes a pinch, where the housing 3 is sealed.

Very often, the housing 3 is made of vitreous material, which has good sealing properties. Furthermore, in many cases such vitreous materials are transparent, which allows ambient light to promote ionization of the medium.

The electrodes 7 and 9 may be made of any suitable material known to the skilled person, such as a nickel-iron alloy. At least one of the electrodes may be provided with a gettering means (not shown), to reduce impurities in the gas filling 5. At least one of the electrodes, such as electrode 9, is provided with, or may be comprised of, a bimetallic element 11. In a non-operative condition, the bimetallic element is provided in a spaced-apart position with respect to the opposite electrode 7. When starting a lamp, a supply voltage is supplied over the starter 1, which causes a glow discharge of the gas filling 5, from electrode 7 to electrode 9 and the bimetal 11. The discharge heats the bimetal, which changes shape until it contacts the opposite electrode 7, upon which the glow discharge is extinguished. Thereupon, the bimetal 11 cools down, and the contact is broken. The resulting voltage surge from a lamp ballast can now ignite the lamp.

It is noted that the bimetal switch as a whole comprises the bimetal element 11, as well as the electrodes 7 and 9. The bimetal element 11 is electrically connected to electrode 9, and after heating contacts the opposite electrode 7. Both electrodes 7 and 9 either are led through the pinch 13 of the housing 3, or are each connected to a lead there through. Such details are deemed familiar to the skilled person.

The properties of the gas filling 5 are important in order to determine the glow time and the ignition voltage.

Some experiments have been performed with gas fillings comprising a) 60% helium and 40% xenon, b) 100% xenon, and c) 90% neon with 10% argon. Some test results are as follows:

TABLE 1

| gas filling | pressure [mbar] | Vignition [V] | Iglow [mA] at waveform of FIG. 3 | tglow at 380 V [s] |
|---|---|---|---|---|
| a) | 20 | 190 | 0.62 | 3.1 |
| a) | 25 | 184 | 1.03 | 1.86 |
| a) | 30 | 179 | 1.45 | 1.41 |
| a) | 35 | 173 | 1.94 | 1.10 |
| b) | 10 | 197 | 0.48 | 4.64 |
| b) | 15 | 172 | 1.19 | 1.75 |
| b) | 20 | 165 | 1.94 | 1.11 |
| b) | 25 | 174 | 2.69 | 0.90 |
| c) | 12 | 137 | 2.38 | 1.61 |
| c) | 18 | 128 | 5.24 | 0.88 |

Based on these test results, one can see that it is well possible to select a gas filling composition and pressure that provides a sufficiently low parallel glow current during operation of the lamp at a good ignition voltage and glow time. In particular, the glow current should be less than 3.5 mA, preferably between 0.5 and 2 mA. The glow time should not be too long, since this prevents sufficient heating of the electrodes of the discharge lamp. Taking for example the helium60/xenon40 mixture, then pressures up to about 35 mbar are well acceptable, not excluding other pressures. Similarly, the pure xenon gas filling b) works well up to about 15 mbar, again not excluding other pressures. The filling c) is less useful, due to a low ignition voltage and a high glow current.

The above examples show that glow-switch starters are suitable for 400V operation, provided the gas filling is adapted to this new voltage.

FIG. 2*a* schematically shows a prior art lighting system, while FIG. 2*b* schematically shows a lighting system according to the invention.

Herein, 18 denotes a prior art glow-switch starter, 20 is a gas discharge lamp, 22 is a choke or ballast, 24 denotes a 230V supply voltage. A three-phase mains voltage is denoted by 26, which is rewired at box or circuit 28 to become the 230V supply voltage.

The gas discharge lamp 20 may be a fluorescent lamp, such as a UV tube, e.g. of a tanning device, or a TL lamp. The ballast 22 is a current limiter for the fluorescent lamp 20, and is selected according to the power rating of the lamp 20.

In the device shown, the actual supply voltage is 230V, which limits the lamp voltage, in practice to about ¾ of said supply voltage. This in turn limits the lamp efficiency and causes relatively high energy losses in the ballast 22 and/or electrodes of the lamp 20.

Note that in many applications, such as professional tanning equipment, the total power consumption is such (sometimes more than 10 kW) that three-phase mains is required as a power supply. Nevertheless, in the device itself, the supply voltage is reduced to 230V.

FIG. 2*b* schematically shows a lighting system according to the invention. Similar parts are denoted by the same reference numerals. A glow-switch starter according to the present invention is denoted by reference numeral 1.

As is clear, the actual supply voltage in the device according to FIG. 2*b* is the full three phase supply voltage, of nominally about 400V. This allows a higher lamp voltage, and subsequently a higher energy efficiency, both through less losses in the ballast 22 and through a more efficient discharge in the lamp 20. Since the voltages across the starter 1 are also different from the prior art situation, the starter 1 should be modified, according to the invention.

FIG. 3 shows a diagrammatical time-voltage graph for a typical low-pressure discharge lamp on a 400 V mains. It can be clearly seen that there is a very narrow ignition peak, at the beginning of each curve. The glow-switch starter will (parallel) glow most during this narrow peak, since (parallel) glowing is much more than linearly dependent of voltage. Hence parallel glowing during the rest of each curve is negligible. It is thus a task of the starter to remain open even under the influence of parallel glowing during the narrow ignition peak. Of course, even though the parallel glowing is much less during the rest of the curve, heating of the starter should still be insufficient to close the switch.

FIG. 4 schematically shows a part of a lighting system according to the invention, comprising a tanning device. The tanning device comprises ten fluorescent lamps 30 for generating UV-A and UV-B light, of which only one lamp is shown in FIG. 4. The distance d between two neighboring fluorescent lamps is typically 40-45 mm. In another embodiment a different number of fluorescent lamps may be present, and/or a different distance d between two neighboring lamps can be used. The fluorescent lamps are coupled to a glow-switch starter, a ballast and a three phase main voltage power supply, as shown in FIG. 2*b*, not shown in FIG. 4. In another embodiment, the three-phase main voltage power supply may be a single power supply for all ten fluorescent lamps. The tanning device further comprises a reflector 32, for reflecting UV light generated by the fluorescent lamps 30, during use of the tanning device, into the direction of the person that uses the tanning device. The reflector 32 has a dedicated shape in order to generate a homogeneous light distribution. In another embodiment a different reflector shape can be used in order to generate a homogeneous light distribution. The fluorescent lamps typically comprise a mixture of helium and neon, a ratio of helium:neon being 1:3, but in another embodiment a different ratio can be used. During use of the tanning device, the fluorescent lamps are typically operated at a lamp voltage of 280-320 V, and a lamp current of 1.4-1.8 A. The fluorescent lamps can be operated at a higher lamp voltage compared to known tanning devices, allowing the lamp power to be increased. As a result of the higher lamp power, the number of fluorescent lamps in the tanning device is reduced compared to known tanning devices. For example, in a known tanning device typically twenty fluorescent lamps are present, typically operable at a lamp voltage of 230-240 V. The higher efficiency of the tanning device according to the invention leads to a lower energy consumption. As the number of ballasts and starters as well as the wiring is also reduced in the tanning device according to the invention, due to the lower number of fluorescent lamps, the component costs are reduced as well.

It is repeated here that it is the realizing that glow-switch starters can be used with higher voltages, be it in a modified form, which lies at the heart of the invention. The invention should not be construed as limited by the described embodiments, but rather, its scope should be determined by the appended claims.

The invention claimed is:

1. A glow-switch starter comprising a substantially gas-tight housing, an ionizable gas filling, at least two electrodes and at least one bimetal switching device, wherein the ionizable gas filling is selected such that, when the glow-switch starter is connected across a gas discharge lamp that is connected in series with an appropriate ballast and that is operating in a steady state at a nominal three-phase mains voltage of at least 250V, the glow-switch starter remains in a stable non-closed position.

2. A glow-switch starter according to claim 1, wherein the ionizable gas filling is selected such that when the gas discharge lamp is operating in a steady state, the glow-switch starter carries an average parallel glow current of less than 4 milliamperes.

3. A lighting device suitable for operation on a three-phase mains voltage power supply, comprising a gas discharge lamp, a ballast suitable for said discharge lamp, and a glow-switch starter according to claim 1.

4. A lighting device according to claim 3, wherein the gas discharge lamp is a low-pressure mercury vapor lamp, or a UV fluorescent lamp.

5. A lighting device according to claim 3, wherein the ionizable gas filling of the glow-switch starter is selected such that, when the gas discharge lamp is operating in a steady state, the glow-switch starter carries an average parallel glow current of less than 3.5 milliamperes.

6. A lighting system comprising the lighting device of claim 3, further comprising a three-phase mains voltage power supply connected to the lighting device, wherein said power supply is able to supply a nominal supply voltage of at least 250Vrms to the lighting device.

7. A lighting system according to claim 6, comprising a tanning device.

8. A lighting device comprising a glow-switch starter according to claim 1 and a three phase voltage as an operating voltage.

9. A glow-switch starter according to claim 1, wherein the ionizable gas filling has a total pressure of from 3 to 60 mbar at room temperature.

10. A glow-switch starter according to claim 1, wherein the total gas pressure is from 10 to 35 mbar.

11. A glow-switch starter according to claim 1, wherein the ionizable gas is selected from helium, neon, krypton, xenon, nitrogen, hydrogen, and a mixture thereof.

12. A glow-switch starter according to claim 1, wherein the ionizable gas filling is a mixture of helium and one or more other gases selected from xenon, krypton, hydrogen, and nitrogen, wherein the ratio of the helium to the other gases is from 1.5 to 1 up to 200 to 1.

13. A glow-switch starter according to claim 1, wherein the ionizable gas filling is substantially krypton at a pressure of from 3 to 10 mbar.

14. A glow-switch starter according to claim 1, wherein the ionizable gas filling is substantially xenon at a pressure of from 3 to 15 mbar.

15. A glow-switch staffer according to claim 1, wherein the ionizable gas filling is substantially hydrogen, nitrogen, or a mixture thereof

16. A glow-switch staffer according to claim 1, wherein argon and hydrocarbons are each present in the ionizable gas filling in a relative amount of less than 10%.

17. A glow-switch starter according to claim 1, wherein argon and hydrocarbons are each present in the ionizable gas filling in a total relative amount of less than 2%.

18. A glow-switch starter according to claim 1, wherein neon is present in the ionizable gas filling in a relative amount of less than 10%.

19. A glow-switch starter according to claim 1, wherein neon is present in the ionizable gas filling in a relative amount of less than 2%.

20. A lighting system comprising the lighting device of claim 3, further comprising a three-phase mains voltage power supply connected to the lighting device, wherein said power supply is able to supply a nominal supply voltage of at least 400V to the lighting device.

* * * * *